US007823413B2

(12) United States Patent
Beving et al.

(10) Patent No.: US 7,823,413 B2
(45) Date of Patent: Nov. 2, 2010

(54) DISTRIBUTED CONDENSING UNITS

(75) Inventors: Frank Beving, Nuenen (NL); Norbert Kaemmer, Stolberg-Breinig (DE)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/398,500

(22) Filed: Apr. 5, 2006

(65) Prior Publication Data

US 2006/0213219 A1 Sep. 28, 2006

Related U.S. Application Data

(63) Continuation of application No. PCT/US2004/033001, filed on Oct. 8, 2004.

(60) Provisional application No. 60/509,469, filed on Oct. 8, 2003.

(51) Int. Cl.
*F25B 43/02* (2006.01)

(52) U.S. Cl. ..... 62/468; 62/509; 62/510

(58) Field of Classification Search ..... 62/468, 62/470, 473, 509, 510, 512, 436, 435
See application file for complete search history.

(56) References Cited

U.S. PATENT DOCUMENTS

| | | | | |
|---|---|---|---|---|
| 3,201,949 A | | 8/1965 | Kocher | |
| 3,234,752 A | * | 2/1966 | Quick et al. | 62/192 |
| 3,675,441 A | * | 7/1972 | Perez | 62/278 |
| 4,084,405 A | * | 4/1978 | Schibbye et al. | 62/197 |
| 4,317,334 A | * | 3/1982 | Burgess | 62/183 |
| 4,809,518 A | | 3/1989 | Murayama | |
| 4,878,357 A | | 11/1989 | Sekigami et al. | |
| 5,211,026 A | * | 5/1993 | Linnert | 62/175 |
| 5,279,131 A | | 1/1994 | Urushihata et al. | |
| 5,490,399 A | * | 2/1996 | Sada | 62/510 |
| 5,548,968 A | | 8/1996 | Sada | |
| 5,687,579 A | * | 11/1997 | Vaynberg | 62/175 |
| 5,987,916 A | | 11/1999 | Egbert | |
| 6,009,715 A | | 1/2000 | Sakurai et al. | |
| 6,205,802 B1 | * | 3/2001 | Drucker et al. | 62/236 |
| 6,453,691 B1 | * | 9/2002 | Seo et al. | 62/228.5 |

(Continued)

FOREIGN PATENT DOCUMENTS

DE 198 05 285 A1 8/1999

(Continued)

OTHER PUBLICATIONS

Abstract of JP 6-229632 A to Ida et al.*

(Continued)

*Primary Examiner*—Mohammad M Ali
(74) *Attorney, Agent, or Firm*—Harness, Dickey & Pierce, P.L.C.

(57) ABSTRACT

A system includes an evaporator unit, a first condensing unit and a second condensing unit. The first condensing unit includes a first heat exchanger coil, a first compressor, and a first oil separator, which removes oil from a refrigerant prior to the refrigerant reaching the first heat exchanger coil. The second condensing unit includes a second heat exchanger coil, a second compressor, and a second oil separator, which removes oil from a refrigerant prior to the refrigerant reaching the second heat exchanger coil. The first oil separator is isolated from the second oil separator to prevent communication of oil therebetween.

16 Claims, 6 Drawing Sheets

U.S. PATENT DOCUMENTS

| | | | | |
|---|---|---|---|---|
| 6,505,475 | B1 | 1/2003 | Zugibe et al. | |
| 6,510,698 | B2 | 1/2003 | Kasai et al. | |
| 6,574,986 | B2 | 6/2003 | Morimoto et al. | |
| 6,599,109 | B2 | 7/2003 | Zamudio et al. | |
| 6,658,867 | B1 * | 12/2003 | Taras et al. | 62/117 |
| 6,698,235 | B2 * | 3/2004 | Nobuta et al. | 62/509 |
| 6,705,093 | B1 * | 3/2004 | Taras et al. | 62/90 |
| 6,766,652 | B2 * | 7/2004 | Kelly et al. | 62/199 |
| 6,860,116 | B2 * | 3/2005 | Lifson et al. | 62/498 |
| 6,973,794 | B2 * | 12/2005 | Street et al. | 62/129 |

FOREIGN PATENT DOCUMENTS

| | | | | |
|---|---|---|---|---|
| EP | 0 715 132 | A1 | | 6/1996 |
| EP | 0715133 | | | 6/1996 |
| EP | 1 046 526 | A2 | | 10/2000 |
| EP | 1 054 221 | A2 | | 11/2000 |
| JP | 2-217763 | A | * | 8/1990 |
| JP | 6-229632 | A | * | 6/1994 |

OTHER PUBLICATIONS

Machine translation of JP 6-229632 A to Ida et al.*

Notification of First Office Action and Text Portion of First Office Action for corresponding Application No. CN 2004800331422 in China (English translation provided by foreign associate - CCPIT Patent and Trademark Law Office), Entitled: Distributed Condensing Units; Aug. 24, 2007; 6 Pages.

Communication received from the EPO regarding Application No. 04 794 374.1 - 2301 dated Oct. 5, 2009.

* cited by examiner

DISTRIBUTED CONDENSING UNITS

CROSS-REFERENCE TO RELATED APPLICATIONS

This application is a National Stage of International Application No. PCT/US2004/033001, filed Oct. 8, 2004, which claims the benefit of U.S. Provisional Application No. 60/509,469, filed on Oct. 8, 2003. The disclosures of the above applications are incorporated herein by reference.

FIELD OF THE INVENTION

The present invention relates to refrigeration systems, and more particularly, to a refrigeration system having a plurality of parallel condensing units.

BACKGROUND OF THE INVENTION

Refrigeration systems typically include a compressor, an evaporator, an expansion valve, a condenser, and a fan which operate together to cool a refrigerated space. The compressor, expansion valve, condenser, and evaporator are fluidly coupled such that a loop or a closed system exists for circulation of a refrigerant therein. The compressor receives the refrigerant in a gaseous form from the evaporator and pressurizes the gas such that the gas can be changed from the gaseous state into a liquid state in the condenser. Once the refrigerant reaches the liquid state in the condenser, the refrigerant is sent through an expansion valve before reaching the evaporator, which is held at a low pressure by the operation of the expansion valve and the compressor. The low pressure of the evaporator causes the refrigerant to change state back to a gas, and as it does so, absorb heat from an air stream moving through the evaporator. In this manner, the air stream flowing through the evaporator is cooled and the temperature of the refrigerated space is lowered.

The fan is typically disposed proximate the evaporator and is operable to generate a flow of air through the evaporator and into a refrigerated space. As previously discussed, an air flow through the evaporator is cooled as a liquid refrigerant passes therethrough. In this regard, the air flow may be regulated to control the temperature of the exiting air stream and the overall temperature of the refrigerated space.

In conventional refrigeration systems, such as those used in HVAC systems, a bank of condenser units are commonly used in conjunction with a bank of evaporators to cool a plurality of refrigerated spaces. In such a situation, each condenser unit includes a compressor fluidly coupled to the bank of evaporator units, whereby the evaporator units are disposed within a building generally proximate a refrigerated space and the condenser units are disposed outside of the building and are operable to expel heat absorbed by the evaporator units. Having the plurality of condenser units in fluid communication with the evaporator units provides the refrigeration system with flexibility as each condenser unit and accompanying compressor unit may be independently activated to provide a desired amount of liquid refrigerant to each of the evaporator units, thereby evenly controlling the cooling of each refrigerated space.

In such a refrigeration system, an oil distribution system is commonly used to control the oil flow between each compressor to properly lubricate the internal components of each compressor. The oil distribution system commonly includes a plurality of oil conduits fluidly coupling each compressor unit to a central oil reservoir to ensure that sufficient lubrication oil is maintained at each of the compressor locations. In this manner, an oil separation device is provided upstream of each condenser unit to inhibit movement of lubrication oil from the compressors to the evaporators via exiting refrigerant. Specifically, the oil separation device prevents any oil spilled over from the individual compressors from entering the refrigeration system and reaching the evaporators. As can be appreciated, any lubrication oil in the refrigeration system generally reduces the effectiveness of the refrigerant, thereby reducing the overall efficiency of the refrigeration system.

While conventional systems adequately supply each of the condensers and associated compressors with a required amount of oil, and adequately separate any lubrication oil from the refrigerant, conventional refrigeration systems suffer from the disadvantage of requiring a complex oil conduit system between each compressor and the centralized oil reservoir.

Therefore, a refrigeration system that effectively separates compressor oil from the refrigerant, while concurrently maintaining the requisite lubrication oil levels within each compressor unit is desirable in the industry. In addition, a refrigeration system that effectively maintains required lubrication oil levels within each compressor without requiring an extensive oil piping arrangement is also desirable. Combining a compressor, oil separator and condenser in a unitary condensing unit having an electronic control system allows use of multiple condensing units in a compact refrigeration system, reduces costly building provisions, allows more indoor space due to equipment reduction, and shortens installation time.

SUMMARY OF THE INVENTION

Accordingly, a refrigeration system is provided and includes a predetermined amount of refrigerant, at least one evaporator unit operable to receive the refrigerant in a liquid state, and at least two condenser units in fluid communication with the evaporator unit and operable to receive the refrigerant in a gaseous state. Each condensing unit includes a scroll compressor operable to pressurize the refrigeration system to cycle the refrigerant between the evaporator unit and the condenser units and a high-efficiency oil separator operable to separate oil from the scroll compressors from the refrigerant prior to the refrigerant entering the condensers. In addition, a liquid receiver unit (LRU) could be provided.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
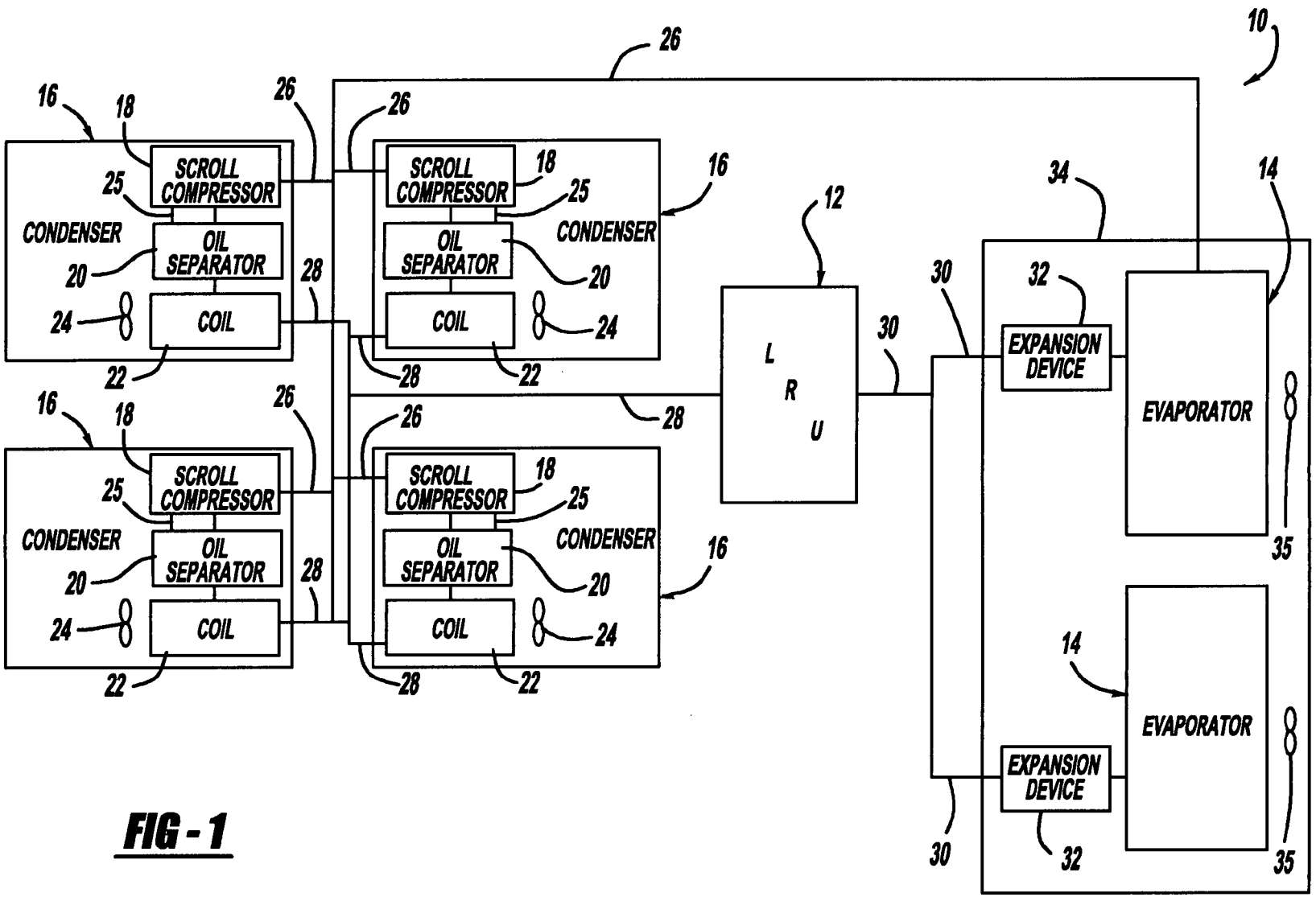
FIG. 1 is a schematic representation of a refrigeration system in accordance with the principals of the present invention.

The following description of the preferred embodiments is merely exemplary in nature and is in no way intended to limit the invention, its application, or uses.

With reference to the figures, a refrigeration system 10 is provided and includes an LRU 12, a bank of evaporators 14, and a bank of condensers 16. The LRU 12 is in fluid communication with both the condensers 16 and the evaporators 14 and is operable to receive refrigerant (not shown) in a liquid state from the condensers 16 and distribute the liquid refrigerant to the evaporators 14.

Each of the condensing units 16 includes a scroll compressor 18, a high-efficiency oil separator 20, a coil 22, and a condenser fan 24. The scroll compressor 18 receives the refrigerant in a gaseous state from the evaporators 14 and returns the gaseous refrigerant to the liquid state through cooperation with the coil 22 and fan 24. Specifically, each compressor 18 is fluidly coupled to the evaporators 14 by a fluid conduit 26 such that gaseous refrigerant exiting the evaporators 14 is received by the compressor 18. Upon receiving the gaseous refrigerant, the scroll compressor 18 increases the pressure of the gaseous refrigerant, thereby causing the refrigerant to circulate through the coil 22 under high pressure. As the refrigerant is circulated through the coil 22, the refrigerant is cooled by the fan 24 circulating an air flow over the coil 22. As the high pressure, gaseous refrigerant is circulated through the coil 22, heat is rejected from the refrigerant and carried away from the coil 22 by the air flow generated by the fan 24. As can be appreciated, such a concurrent reduction in temperature and increase in pressure causes the gaseous refrigerant to change state and revert back to the liquid state.

The scroll compressor 18 is substantially equivalent to the scroll compressor as disclosed by U.S. Pat. No. 6,350,111 assigned to Copeland Corporation of Sidney, Ohio, U.S.A., which is expressly incorporated herein by reference. In this manner, the compressor 18 utilizes an oil reservoir disposed within a crankcase of each individual compressor unit 18 for use in lubricating and maintaining functional components of the compressor 18. The refrigerant is cycled through the compressor 18 to increase the pressure of the refrigerant and force the refrigerant into the coil 22 under high pressure. In this regard, the refrigerant may mix with lubrication oil from the compressor 18 in the event that any lubrication oil spills or carries over from the crankcase. However, due to the nature of the internal lubrication oil reservoir of each scroll compressor 18, a relatively small amount of lubrication oil will escape the crankcase and spill over.

Should the compressor 18 experience a condition where lubrication oil spills over from the crankcase and into the refrigerant, the high-efficiency oil separator 20 separates the lubrication oil from the refrigerant prior to the refrigerant reaching the coil 22. Specifically, the oil separator 20 is disposed between, and is in fluid communication with, the scroll compressor 18 and coil 22 such that as the high pressure, gaseous refrigerant is pressurized by the compressor 18, the refrigerant first passes through the high-efficiency oil separator 20 prior to reaching the coil 22, as best shown in FIG. 1. The high-efficiency oil separator removes the lubrication oil from the gaseous refrigerant with an efficiency of approximately 99.8% such that only a small amount, if any, lubrication oil reaches the coil 22.

As previously discussed, the scroll compressor 18 experiences a small amount of loss or spill over of lubrication oil from the crankcase due to the nature of the crankcase in the scroll compressor 18. In this manner, it is unlikely that sufficient lubrication oil will spill from the crankcase to enter the refrigerant. However, should any lubrication oil spill from the crankcase and commingle with the refrigerant flow, the high-efficiency oil separator 20 (i.e., an efficiency of approximately 99.8%) will capture the lubrication oil, thereby preventing lubrication oil from reaching the coil 22. In other words, the cooperation between the scroll compressor 18 and the high-efficiency oil separator 20 will prevent most, if not all, of the lubrication oil from reaching the coil 22.

Separated lubrication oil is housed within the oil separator 20 prior to being discharged to the compressor 18. Specifically, once the lubrication oil is captured by the oil separator 20, the oil is returned to the compressor 18 via conduit 25. Conduit 25 is in fluid communication with both the compressor 18 and high-efficiency oil separator 20 and serves to deliver the captured oil back into the scroll compressor 18 for further use. It should be noted that while the conduit 25 has been described as being in fluid communication with the compressor 18 and oil separator 20, it could alternatively be in fluid communication with conduit 26 such that the captured oil is introduced upstream of the compressor 18 and cycled through the compressor 18 with the gaseous refrigerant.

Figure 2:
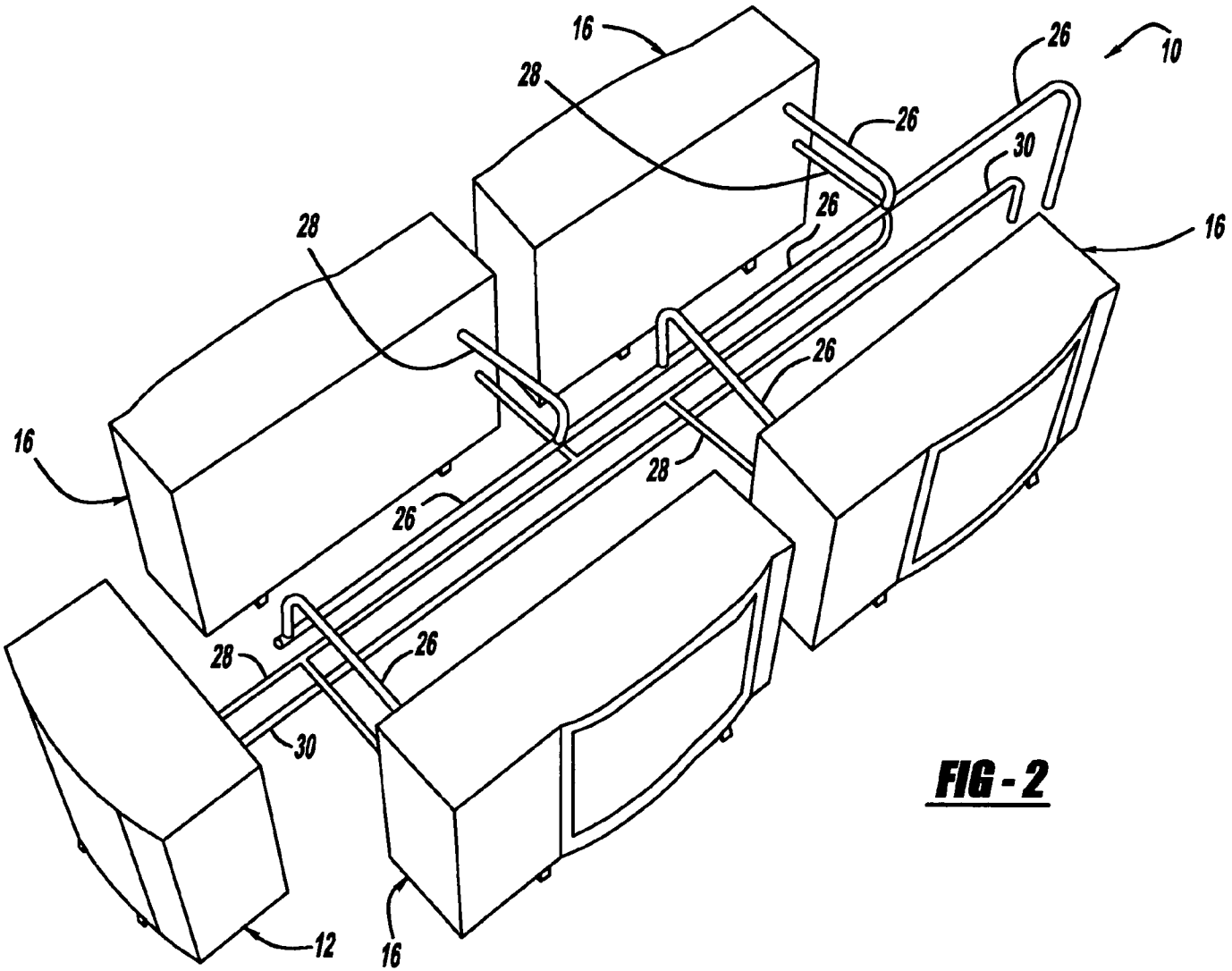
FIG. 2 is a perspective view of the refrigeration system of FIG. 1.

As best shown in FIGS. 1 and 2, the LRU 12 is disposed between the condensers 16 and the evaporators 14 and controls the flow of liquid refrigerant from the condensers 16 to the evaporators 14. The LRU 12 is in fluid communication with the condensers 16 via conduit 28 and in fluid communication with the evaporators 14 via conduit 30. Once the high pressure, gaseous refrigerant has sufficiently traveled through the coil 22, the refrigerant will change state and return to the liquid state. Once the refrigerant has reached the liquid state, the LRU 12 draws the liquid refrigerant from the condensers 16 via conduit 28 and delivers the liquid refrigerant to the evaporators 14 upon demand via conduit 30.

An expansion device 32 is disposed between, and in fluid communication with, the LRU 12 and the evaporators 16 via conduit 30 to aid in the effectiveness of the refrigerant upon reaching the evaporators 16. The expansion device 32 reduces the pressure of the liquid refrigerant to thereby ease the transition of the refrigerant from the liquid state and to the gaseous state. As can be appreciated, such conversion causes the refrigerant to absorb heat from an area surrounding the evaporators, thereby cooling the surrounding area, as will be discussed further below.

As the liquid refrigerant is allowed to expand via expansion device 32, the refrigerant starts to transition from the liquid state to the gaseous state. A fan 35 circulates an air flow through the evaporator 16 such that heat from the air flow is absorbed by the refrigerant, thereby cooling a refrigerated space 34 disposed proximate the evaporator 14. The heat absorption, combined with the decrease in pressure caused by the expansion valve 32, causes the refrigerant to change state back into the gaseous state. Once the refrigerant reaches the gaseous state, the gaseous refrigerant is drawn toward the condensing units 16 once again due to a suction imparted thereon by the compressors 18. As the compressors 18 are fluidly coupled to the evaporators 16 via conduit 26, the compressors 18 create a suction in conduit 26 as gaseous refrigerant is compressed in the condensing units 16. In this manner, the gaseous refrigerant disposed in the evaporators 14 is drawn into the compressors 18 and the cycle begins anew.

Figure 3:
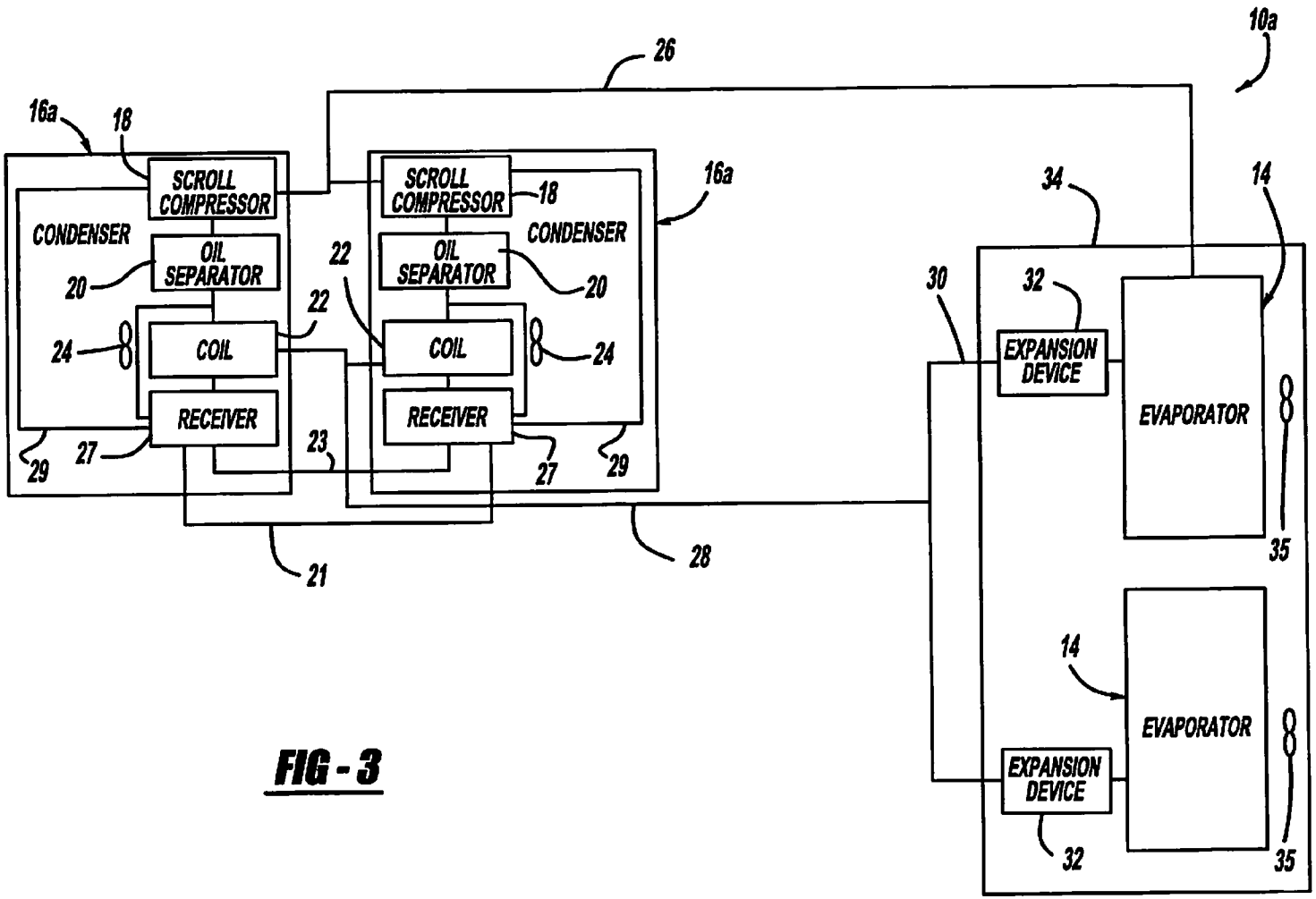
FIG. 3 is a schematic representation of a second embodiment of a refrigeration system in accordance with the principles of the present invention.

With particular reference to FIG. 3, a second embodiment of the refrigeration system 10 is shown. In view of the substantial similarity in structure and function of the refrigeration system 10 with respect to the refrigeration system 10*a*, like reference numerals are used hereinafter and in the drawings to identify like components while like reference numerals containing letter extensions are used to identify those components that have been modified.

An LRU 12 may be used when three or more condensing units 16 are combined in one refrigeration system, as shown in FIGS. 1 and 2. However, with two condensing units 16*a* combined in one refrigeration system 10*a*, internal liquid receivers 27 may be used in each unit 16*a* to store the liquid refrigerant and are connected with each other via conduit 23 for gas pressure and liquid level equalization in both receivers 27.

The receivers 27 convert liquid refrigerant from the coil 22 into high-pressure vapor refrigerant and a sub-cooled liquid refrigerant. The high-pressure vapor refrigerant is piped into the compressor 18 via conduit 29 while the sub-cooled liquid refrigerant is piped to the evaporators 14 via conduits 28, 30 and expansion device 32.

Figure 4:
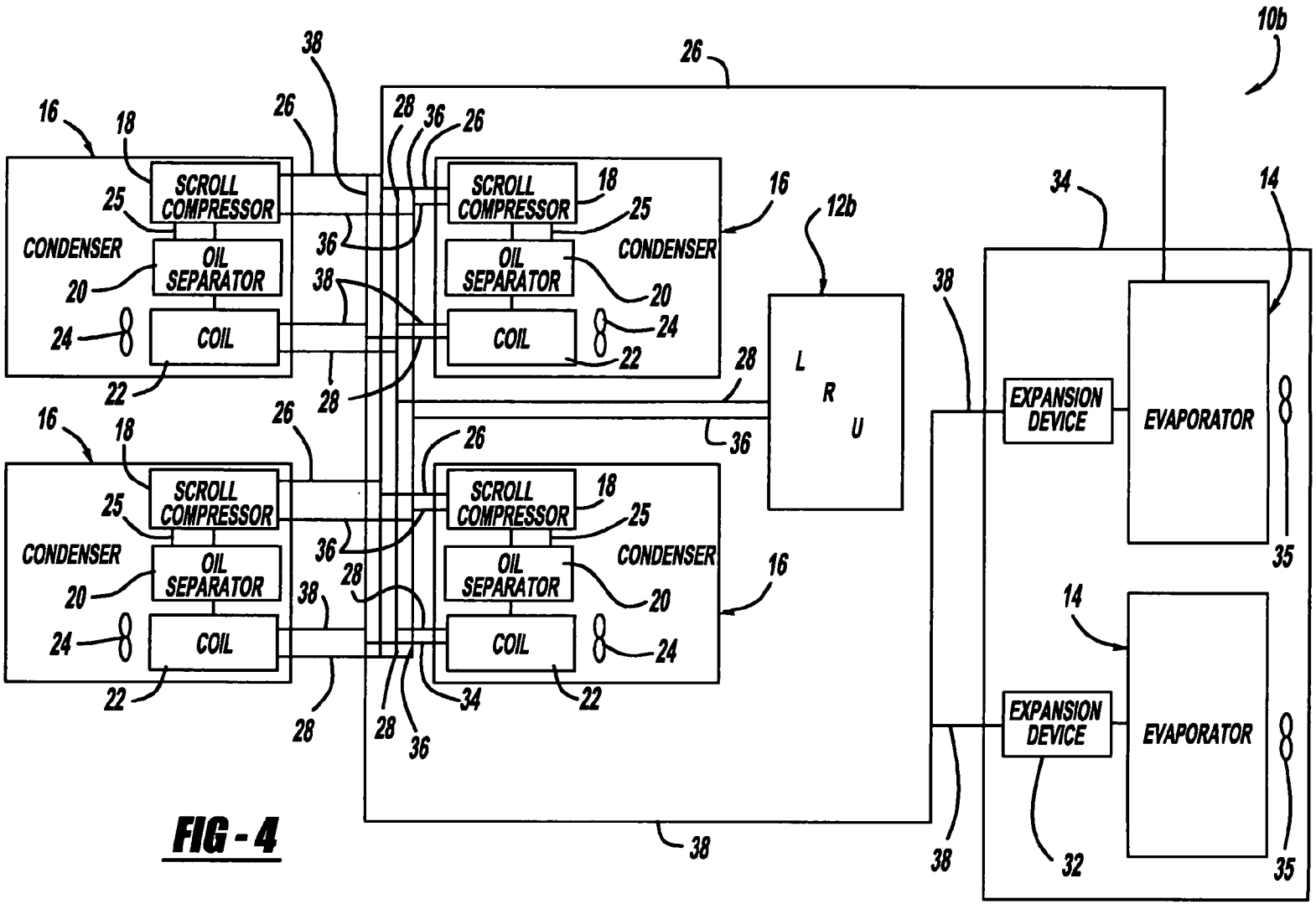
FIG. 4 is a schematic representation of a third embodiment of a refrigeration system in accordance with the principles of the present invention.
Figure 5:
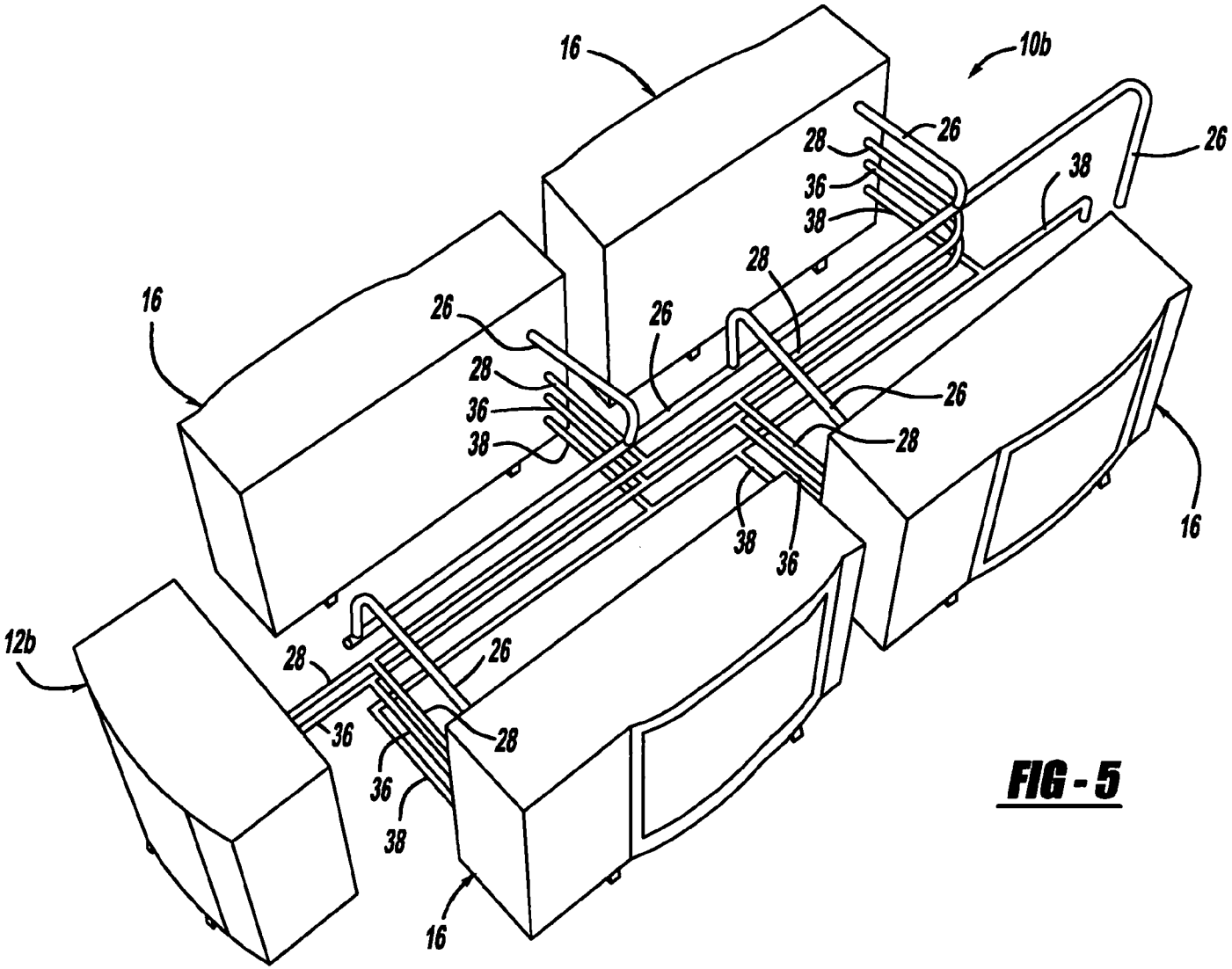
FIG. 5 is a perspective view of the refrigeration system of FIG. 4.

With reference to FIGS. 4 and 5, a third embodiment of the refrigeration system 10 incorporating a sub cooling feature will be described in detail. In view of the substantial similarity in structure and function of the refrigeration system 10 with respect to the refrigeration system 10*b*, like reference numerals are used hereinafter and in the drawings to identify like components while like reference numerals containing letter extensions are used to identify those components that have been modified.

The refrigeration system 10*b* incorporates the LRU 12*b*, a bank of evaporators 14, and a bank of condensing units 16. The LRU 12*b* is in fluid communication with both the condensers 16 and the evaporators 14 and is operable to receive refrigerant (not shown) in a liquid state from the condensing units 16 and distribute the liquid refrigerant back through the condensing units 16 to provide the evaporators 14 with a sub cooled liquid refrigerant. In other words, the LRU 12*b* is operable to re-circulate liquid refrigerant through the condensing units 16*a* to further enhance the ability of the refrigerant to absorb heat at the evaporators 14 and provide a refrigerated space 34 with additional cooling abilities, as will be discussed further below.

The condensing units 16 receive gaseous refrigerant from the evaporators via conduit 26 and are operable to compress the gaseous refrigerant and cause the refrigerant to revert back to the liquid state via scroll compressor 18, oil separator 20, and fan 24, as previously discussed in detail above. Once the refrigerant reaches the liquid state, the pressure imparted thereon causes the liquid refrigerant to flow to the LRU 12*b* via conduit 28. At this point, the LRU 12*b* is operable to control the flow of the liquid refrigerant and can selectively send the liquid refrigerant back to the condensing units 16 for further cooling via conduit 36. This arrangement increases the ability of the liquid refrigerant to absorb heat at the evaporators 14, and thus, increases the ability of the evaporators 14 to cool the refrigerated space 34.

Once the condensing units 16 have reprocessed the liquid refrigerant, the refrigerant is discharged from the heat exchanger and sent to the evaporators 14 through conduit 38. As previously discussed, the liquid refrigerant is allowed to expand via expansion device 32 to begin the transition from the liquid state to the gaseous state. In doing so, a fan 35 circulates an air flow through the evaporator 16 such that heat from the air flow is absorbed by the refrigerant, thereby cooling the refrigerated space 34 disposed proximate the evaporator 14. As can be appreciated, such heat absorption, combined with the decrease in pressure caused by the expansion valve 32, causes the refrigerant to change state back into the gaseous state.

Once the refrigerant reaches the gaseous state, the gaseous refrigerant is drawn towards the condensing units 16 once again due to a suction imparted thereon by the compressors 18. Specifically, the compressors 18 are fluidly coupled to the evaporators 14 via conduit 26 such that as the compressors 18 increase the pressure of refrigerant disposed within the compressor 18, a suction is imparted on conduit 26, thereby causing the gaseous refrigerant from the evaporators 14 to be drawn into the compressors 18.

It should be noted that the refrigeration system 10*b* similarly uses a high-efficiency oil separator 20 in combination with a scroll compressor 18, and as such, obviates the need for extensive oil piping systems to supply each compressor 18 with sufficient lubrication oil. The high-efficiency oil separator 20 is operable to separate lubrication oil from the liquid refrigerant prior to the refrigerant reaching the coil 22. Upon separation, the lubrication oil is housed within the oil separator 20 prior to being discharged to the compressor 18. Specifically, once the lubrication oil is captured by the oil separator 20, the oil is returned to the compressor 18 via conduit 25. Conduit 25 is in fluid communication with both the compressor 18 and high-efficiency oil separator 20 and serves to deliver the captured oil back into the scroll compressor 18 for further use, as previously discussed.

Figure 6:
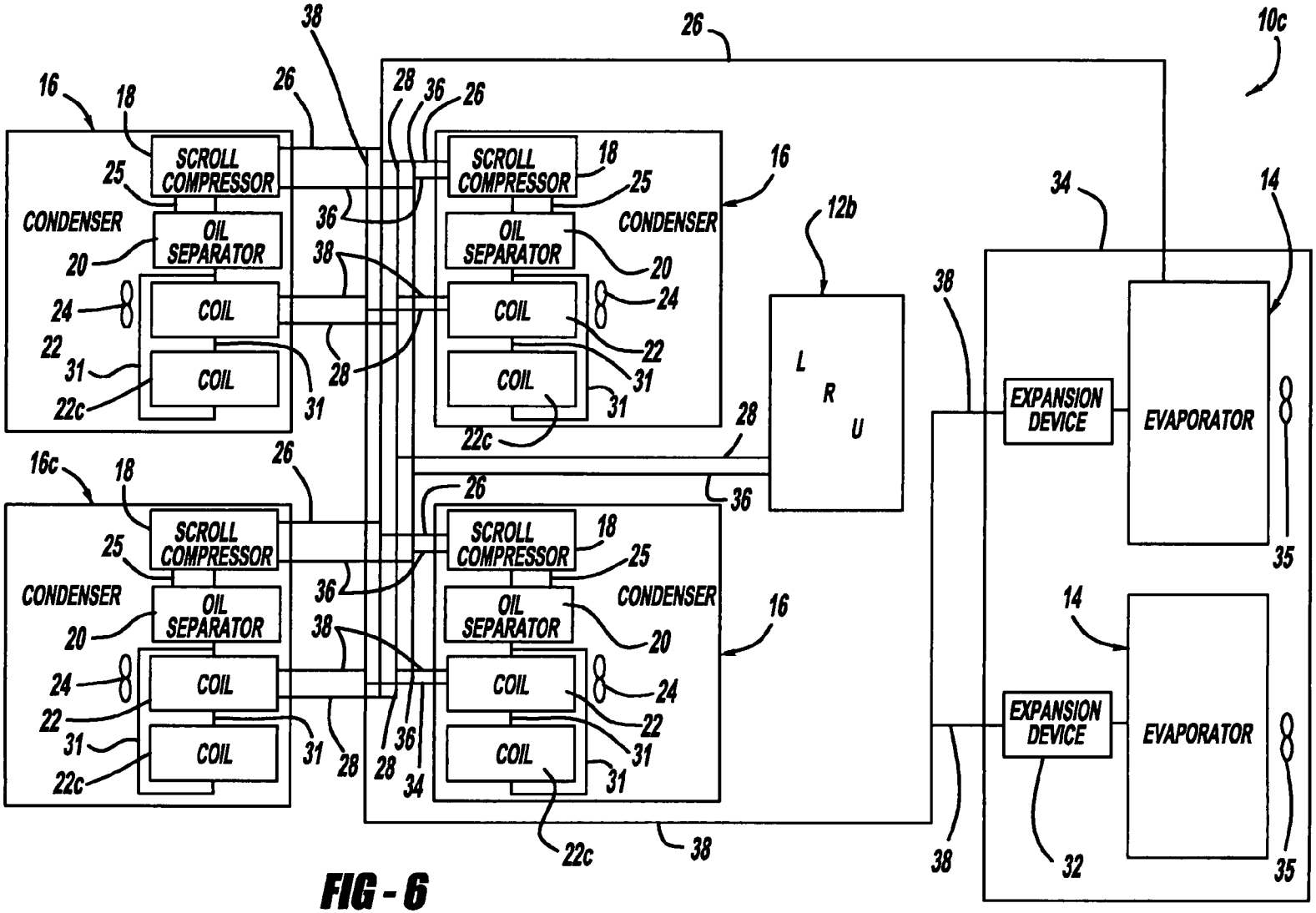
FIG. 6 is a schematic representation of a fourth embodiment of a refrigeration system in accordance with the principles of the present invention.

With reference to FIG. 6, a fourth embodiment of the refrigeration system 10 is shown. In view of the substantial similarity in structure and function of the refrigeration system 10 with respect to the refrigeration system 10*c*, like reference numerals are used hereinafter and in the drawings to identify like components while like reference numerals containing letter extensions are used to identify those components that have been modified.

The condensing units 16*c* include an additional coil 22*c* fluidly coupled to both the outlet and the inlet of coil 22 via conduit 31. In this manner, the refrigeration is split into two flows. The refrigerant is in fluid communication with the primary circuit of a heat exchanger through an expansion device 32 and in fluid communication with compressor 18. The other flow is in fluid communication with the secondary coil 22*a* of the heat exchanger in order to be further cooled after leaving the coil 22, thereby increasing the effectiveness of the condensing unit 16*c*.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A refrigeration system comprising:

a predetermined amount of refrigerant;

at least one evaporator unit operable to receive said refrigerant in a liquid state;

at least two condensing units in fluid communication with said at least one evaporator unit and operable to receive said refrigerant in a gaseous state, said at least two condensing units each including a first heat exchanger and a compressor operable to pressurize the refrigeration system to cycle said refrigerant between said at least one evaporator unit and said at least two condensing units; and a liquid receiver unit operable to store said refrigerant from at least one of said first heat exchangers and to re-circulate said refrigerant back through said at least one of said first heat exchangers for sub-cooling prior to returning to said liquid receiver unit.

2. The refrigeration system of claim 1, wherein each of said at least two condensing units includes an oil separator operable to separate oil from said refrigerant.

3. The refrigeration system of claim 2, wherein said oil separator removes 99.8% or more of said oil from said refrigerant.

4. The refrigeration system of claim 1, wherein said compressor is a scroll compressor.

5. The refrigeration system of claim 1, further comprising a second heat exchanger associated with each of said at least two condensing units and including an inlet fluidly coupled to an outlet of said first heat exchanger and operable to sub-cool said refrigerant received from said first heat exchanger.

6. The refrigeration system of claim 1, wherein said first heat exchangers of said at least two condensing units are in fluid communication.

7. The refrigeration system of claim 1, further comprising an oil separator disposed upstream from said first heat exchanger in each of said at least two condensing units.

8. A refrigeration system comprising:

a predetermined amount of refrigerant;

at least one evaporator unit operable to receive said refrigerant in a liquid state; and at least two condensing units in fluid communication with said at least one evaporator unit and operable to receive said refrigerant in a gaseous state, said at least two condensing units comprising:

a compressor operable to pressurize the refrigeration system to cycle said refrigerant between said at least one evaporator unit and said at least two condensing units;

a first heat exchanger operable to change said refrigerant from said gaseous state to said liquid state; and a second heat exchanger receiving said refrigerant exiting said first heat exchanger and operable to sub-cool said refrigerant, said second heat exchanger having an inlet directly coupled to an outlet of said first heat exchanger.

9. The refrigeration system of claim 8, wherein each of said at least two condensing units includes an oil separator operable to separate oil from said refrigerant.

10. The refrigeration system of claim 9, wherein said oil separator removes 99.8% or more of said oil from said refrigerant prior to said refrigerant entering said first heat exchanger.

11. The refrigeration system of claim 9, wherein said oil separator is disposed between an outlet of said compressor and an inlet of said first heat exchanger.

12. The refrigeration system of claim 8, wherein said first heat exchanger includes a first coil and said second heat exchanger includes a second coil.

13. The refrigeration system of claim 12, wherein said first coil is spaced apart and separated from said second coil.

14. The system of claim 8, wherein said compressor is a scroll compressor.

15. The system of claim 8, further comprising a liquid receiver unit in fluid communication with said at least two condensing units.

16. The system of claim 15, wherein said liquid receiver unit receives sub-cooled refrigerant from said at least two condensing units.

* * * * *